US005581161A

United States Patent [19]

Gong

[11] Patent Number: 5,581,161

[45] Date of Patent: Dec. 3, 1996

[54] DC COUPLED ELECTRONIC BALLAST WITH A LARGER DC AND SMALLER AC SIGNAL

[76] Inventor: Mingfu Gong, 2317 N. 50th St., Philadelphia, Pa. 19131

[21] Appl. No.: 274,218

[22] Filed: Jul. 13, 1994

[51] Int. Cl.[6] ..... H05B 37/02

[52] U.S. Cl. ..... 315/307; 315/209 R; 315/DIG. 7

[58] Field of Search ..... 315/82, 224, 247, 315/209 R, 307, DIG. 7, DIG. 5, 308, 241 R, 205

[56] References Cited

U.S. PATENT DOCUMENTS

| | | | |
|---|---|---|---|
| 1,939,903 | 12/1933 | Kayser . | |
| 2,091,953 | 9/1937 | Becquemont . | |
| 3,700,960 | 10/1972 | Lake | 315/151 |
| 3,969,652 | 7/1976 | Herzog | 315/224 |
| 4,004,188 | 1/1977 | Cooper | 315/261 |
| 4,188,661 | 2/1980 | Bower et al. | 363/49 |
| 4,327,309 | 4/1982 | Wallot | 315/170 |
| 4,392,087 | 7/1983 | Zansky | 315/219 |
| 4,623,824 | 11/1986 | Scolari et al. | 315/241 R |
| 4,692,667 | 9/1987 | Nilssen | 315/209 R |
| 4,777,409 | 10/1988 | Tracey et al. | 315/200 R |
| 4,862,042 | 8/1989 | Herrick | 315/291 |
| 4,958,107 | 9/1990 | Matias et al. | 315/289 |
| 4,972,124 | 11/1990 | Powers | 315/219 |
| 4,983,888 | 1/1991 | Akutsu et al. | 315/242 |
| 5,021,716 | 6/1991 | Lesea | 315/219 |
| 5,028,846 | 7/1991 | Lesea | 315/219 |
| 5,051,666 | 9/1991 | Jensen | 315/307 |
| 5,134,556 | 7/1992 | Courier De Mere | 363/37 |
| 5,165,053 | 11/1992 | Jones | 315/224 |
| 5,343,122 | 8/1994 | Sugimori et al. | 315/209 R |

*Primary Examiner*—Robert Pascal
*Assistant Examiner*—David Vu
*Attorney, Agent, or Firm*—Eckert Seamans Cherin & Mellott

[57] ABSTRACT

A low cost, high efficiency electronic larger DC/smaller AC ballast for fluorescent lamps and other gas discharge devices uses fast react feedback and constant power sources to power a fluorescent lamp at a stable working point and to reduce the accuracy requirements of related components. An input-side chopper regulator provides a DC supply voltage. A voltage multiplier in combination with the input-side chopper smoothly and reliably starts the lamp, providing high voltage at low current during startup, and minimal loading thereafter. A second constant power source drives the bulb via an output side chopper coupled to a storage capacitor and inductor, maintaining larger DC/smaller AC operation while reducing harmonics. The operational voltage applied to the load has a large DC component and a smaller AC component, thereby reducing electrophoresis effects. The constant power sources can be adjustable manually or automatically, for dimming control.

11 Claims, 3 Drawing Sheets

DC COUPLED ELECTRONIC BALLAST WITH A LARGER DC AND SMALLER AC SIGNAL

BACKGROUND OF THE INVENTION

1. Field of the Invention

The invention relates to the field of direct current power supplies having starting devices for powering loads such as gas discharge devices including fluorescent lamps, halogen lamps, arc lamps and the like. In particular, the invention provides an electronic ballast circuit having two constant power regulators and a voltage multiplying starting circuit having a current output that varies with load resistance and is loaded to the point that starter current is turned substantially off after the load has started.

2. Prior Art

Gas discharge devices such as fluorescent and halogen lamps, typically having gases enclosed in a glass envelope, emit light when gases are ionized and during conduction of current through the ionized gases, their electrons change energy state. The typical lamp comprises an elongated tube with electrodes at opposite ends, although other configurations also are possible. In order to start the lamp, the gas must be ionized. This can be accomplished by keeping the gas heated, or by applying a high voltage starting signal. Once the gas is ionized, the resistance between the electrodes (i.e., through the gas) is reduced substantially due to ionization. In the steady state mode of operation, the voltage needed to emit light is lower than the starting voltage. So-called "warm-start" or "rapid-start" ballasts for such lamps dissipate power when the lamp is off, to maintain its readiness to start. "Instant-start" ballasts apply a high voltage spike to ionize the gas and start the lamp.

Electronic ballasts for fluorescent lamps can offer better efficiency, faster start times, and higher power efficiency compared with traditional inductor ballasts. A major drawback of electronic ballasts is their cost as compared to inductor ballasts. The costs of parts and manufacturing are typically much higher for electronic ballasts because many more parts and connections are needed.

Electronic ballasts can be distinguished between AC ballasts and DC ballasts, depending on the fluorescent lamp's working mode. In an AC ballast, a high frequency AC voltage is applied to the electrodes of a fluorescent bulb, for example at 10 to 50 KHz, and typically at 25 to 35 KHz. As shown, for example, in U.S. Pat. No. 5,021,716—Lesea, an AC signal is generated by an oscillator and a voltage step-up transformer. A DC ballast is also possible wherein a DC voltage is applied across the electrodes. Most commercial electronic ballasts are AC types, because it is readily possible to start and to control the lamp output level at a stable working point.

The AC output is coupled to the electrodes via a power coupling high frequency transformer, and control of the electronic ballast typically is based on a current feedback signal, requiring a second transformer for sensing. Such high frequency transformers are also expensive. In order to obtain feedback of the average signal level to the control, AC ballasts generally need high accuracy components. Special tuning and setup may be necessary during manufacturing, which increases the manufacturing cost. It would be advantageous if the cost of an electronic ballast could be reduced without sacrificing efficiency and good control characteristics, perhaps including dimming control.

Another drawback of AC ballasts is the emission of electromagnetic radiation at the basic working frequencies (10 to 50 KHz), and their harmonics. The AC current in the lamp at such frequencies causes an antenna effect, and the power couplings through the transformer and along connecting conductors also radiate at such frequencies. This radiation is a kind of electromagnetic pollution. Whether or not electromagnetic radiation is harmful to humans, such radiation produces adverse effects in instrumentation in which signals are induced. For example, in environments having electronic test equipment, such as in hospitals, electronic ballasts are generally not useful due to the induction of high frequency signals in test equipment such as electrocardiograph machines and the like.

A DC ballast produces little electromagnetic radiation and need not include expensive high frequency transformers. However, there can be problems with dependably starting the lamp. It can be difficult to control the current level to a stable working point. A cataphoresis or electrophoresis effect is observed wherein the light output near the anode decreases compared to the light output near the cathode, because the direct current causes migration of positively charged mercury ions toward the cathode. These problems are not encountered in AC ballasts.

U.S. Pat. Nos. 4,777,409—Tracy et al. and 4,983,888—Akutsu et al. disclose DC type ballasts for a small (4 inch or 5 cm) exit sign bulb, and for a U-shaped combined fluorescent and incandescent bulb arrangement, respectively. In each case the DC ballasts include a bridge rectifier and chopper means associated with a series regulating transistor, for generating a pulsed DC signal that is filtered for applying a smoothed and rectified signal to the gas discharge tube. In Tracy, the lamp is started by applying the rectifier output to heat the electrodes resistively. The electrodes each have two terminals and initially are coupled to the regulator output by a bimetallic starter in series with the electrodes. As the electrodes are heated, the starter heats up and opens. Operating current is then limited by feedback to the chopper via a current sensing resistor in series with the bulb.

In Akutsu et al., a separate starter device can be coupled to the discharge tube as in Tracy, or according to additional alternatives, a capacitor in parallel with the electrodes can allow a starting current to heat the electrodes until it is charged, or a switching device can initially apply a heating current to the electrodes. An incandescent lamp is provided in series with the fluorescent lamp and presumably helps to heat the gases in the tube. Akutsu combats electrophoresis effects by using a special tube. A mercury amalgam insert at the anode diffuses additional mercury from the insert into the tube, which is said to provide a fresh supply of electrons that counteracts the tendency of the positively charged ions to migrate to the cathode.

It would be advantageous to provide a DC electronic ballast that does not need special amalgams, and yet which overcomes problems with electrophoresis. It would also be advantageous to provide a starter for a DC electronic ballast that does not resistively heat the electrodes, which tends to wear them and contribute to premature failure of the lamp. It would also be advantageous to provide a DC electronic ballast that can be controlled for dimming and has a minimum of components.

SUMMARY OF THE INVENTION

It is an object of the invention to provide a DC coupled electronic ballast using constant power control rather than constant voltage control and/or constant current control.

It is another object of the invention to employ dual constant power control for reducing harmonics and for setting an operational current level to the load.

It is a further object of the invention to provide a combination of pulse width modulation and pulse frequency modulation with at least one of feedback control and manual dimming input, in a DC coupled electronic ballast.

It is a further object of the invention to employ voltage multiplying circuits to provide an initial high startup voltage and very small startup current for a DC ballast, thereby minimizing wear on the electrodes of a gas discharge lamp.

These and other objects are accomplished by a ballast power supply circuit for operating a load at a constant power level after startup, at a drive voltage having AC and DC components, the DC component being substantially larger than the AC component. A rectifier is coupled to an AC power source and provides an unregulated DC signal, for example a full wave rectified signal from a bridge rectifier.

On an input side, a first constant power regulator having a chopper switch driven by an oscillator is coupled to the unregulated DC signal and produces a pulse train output that charges a filter capacitor to provide a regulated voltage. A sensing resistor in series with the chopper varies the triggering point of the oscillator to vary the pulse width and frequency of chopper operation.

The regulated output on the filter capacitor is coupled on an output side to a capacitor in parallel with the load, for example to a positive terminal of a fluorescent tube or other gas discharge device. One terminal of an inductor is coupled to a negative terminal of the load (and to the parallel capacitor). A second constant power regulator with an oscillator and chopper switch is coupled between the opposite terminal of the inductor and a current sensing resistor leading to ground. A diode has its anode coupled to the chopper switch and the inductor, and its cathode coupled to the positive terminal of the load.

In alternate cycles of the chopper switch on the output side, the inductor and the capacitor store energy and discharge energy to the load, respectively. The current sensing resistor provides a control voltage setting the pulse width and frequency of the oscillator, providing a constant power level output to the load, although the voltage varies.

A manually adjustable dimmer control can be provided by coupling a potentiometer or the like to the current sensing resistor on the output side. In a preferred arrangement for cold starting, a startup circuit provides a high voltage to the load via a voltage multiplier, the startup circuit being loaded and supplemented by a current through a blocking diode as the load begins to conduct and its resistance drops off. The startup circuit is coupled to the regulated output of the input side. The first regulator, on the input side, converts the line voltage to about 350 to 380 VDC at startup, which drops to about 200 to 300 VDC during normal operation, for good efficiency.

In combination with the chopper, the voltage multiplier boosts the voltage across the load during startup briefly to about 1,500 V. The startup circuit has a plurality of serially coupled forward-biased diodes and a plurality of capacitors coupled between anodes and cathodes of adjacent ones of the diodes, for multiplying a voltage of the regulated output. Alternatively, a warm-up type starter can be used, with a bimetallic switch in parallel with the load for heating the electrodes of the gas discharge device resistively until the bimetallic switch opens.

The voltage applied to the load is substantially a DC voltage, but includes an AC component having an amplitude, for example, of about ten percent of the DC value. This reduces electrophoresis effects without generating substantial electromagnetic emission.

On the output side, the regulated output of the first constant power regulator is coupled to a first terminal of the load. The capacitor and inductor network comprise a capacitor in parallel with the load and a resistor in series with the load, the second constant power regulator being coupled in series with the inductor such that the chopper switch of the second regulator conducts to ground through its current sensing resistor. A diode is coupled with its anode at the inductor and its cathode coupled to the first terminal of the load. The diode routes the voltage from the discharging inductor to the load when the chopper switches off. When the chopper switch is on, current is coupled to the load and the capacitor and inductor are charged again.

By means of the invention, problems in AC type electronic ballasts, such as their cost and emission of electromagnetic radiation, are overcome. Problems in DC type electronic ballasts, such as starting problems, stability and electrophoresis, are solved by operating the gas discharge lamp in a larger DC/smaller AC mode. This larger DC/smaller AC mode reduces the cost and electromagnetic radiation, and is advantageously arranged with a voltage multiplier for providing a fast reacting DC starter to improve starting and stability.

The voltage multiplying starter requires no active switching and no inductors, and reacts quickly to provide a high voltage across a cold bulb at low current. When the gas in the lamp ionizes, the voltage drops off due to the decreasing resistance of the load. The starter then becomes substantially inactive. Whereas the electrodes of the bulb are not heated resistively in this manner, the life span of the bulb is improved. It is readily possible to operate the ballast to drive full size (e.g., 4 foot or 1.25 m) fluorescent bulbs, at greatly reduced levels of electromagnetic emission.

The parallel capacitor provides current by cooperating with the DC starter during starting, and changes the lamp working point to improve the efficiency after the lamp has started. An effect of the parallel capacitor is that the lamp current is the sum of the DC current plus a small AC current. This AC current is helpful to reduce the electrophoresis effect caused by the DC current. However, the relatively small AC current radiates an electromagnetic field strength of only 1/10 to 1/100 of the typical electromagnetic field strength produced by a normal AC ballast.

Regulation using a combination of pulse width modulation and pulse frequency modulation in the constant power regulator offers a fast react and stable working point that is particularly apt for powering a fluorescent bulb, and due to its switching mode is efficient. As the current pulse width is reduced, the pulse frequency increases to maintain the energy consumed by the fluorescent bulb substantially constant at a given working input voltage range. A constant power source normally would preclude the application of additional power for starting, but this problem is solved by the voltage multiplying fast DC starter, in conjunction with the parallel capacitor, and requires no active switching to change between the startup and operational modes.

Where safety is a major concern and low voltages are indicated, a conventional warm-start method is preferred, with a switching means such as a bimetallic switch for resistive heating of the bulb filaments or electrodes to ionize the gas and start the bulb. According to the warm-up alternative embodiment of the invention, the lamp filaments are coupled as part of the ballast circuits. One filament is in series with the positive power voltage of the ballast control circuits, and both sides are in series with the starter. The ballast will not work if either filament is broken. This prevents an electrical shock caused by accidentally touching the bulb filament connecters.

The first constant power regulator provides the necessary voltage during startup and during operation, and is reliable, efficient and simple from a circuitry standpoint. The combined pulse width and pulse frequency operation provides constant power regulation as well as the high frequency chopper signal needed by the voltage multiplier, while limiting harmonic currents.

Whereas the ballast of the invention includes two constant power regulators, various forms of dimming control are readily possible, for example relying on manual control, optical or thermal sensing or the like to vary the frequency of chopper operation. In one embodiment, a manually adjustable potentiometer can effect such a control by changing the value of the current sensing resistor.

Additional aspects of the invention, as well as variations and alternative embodiments, will be apparent from the following discussion of practical examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
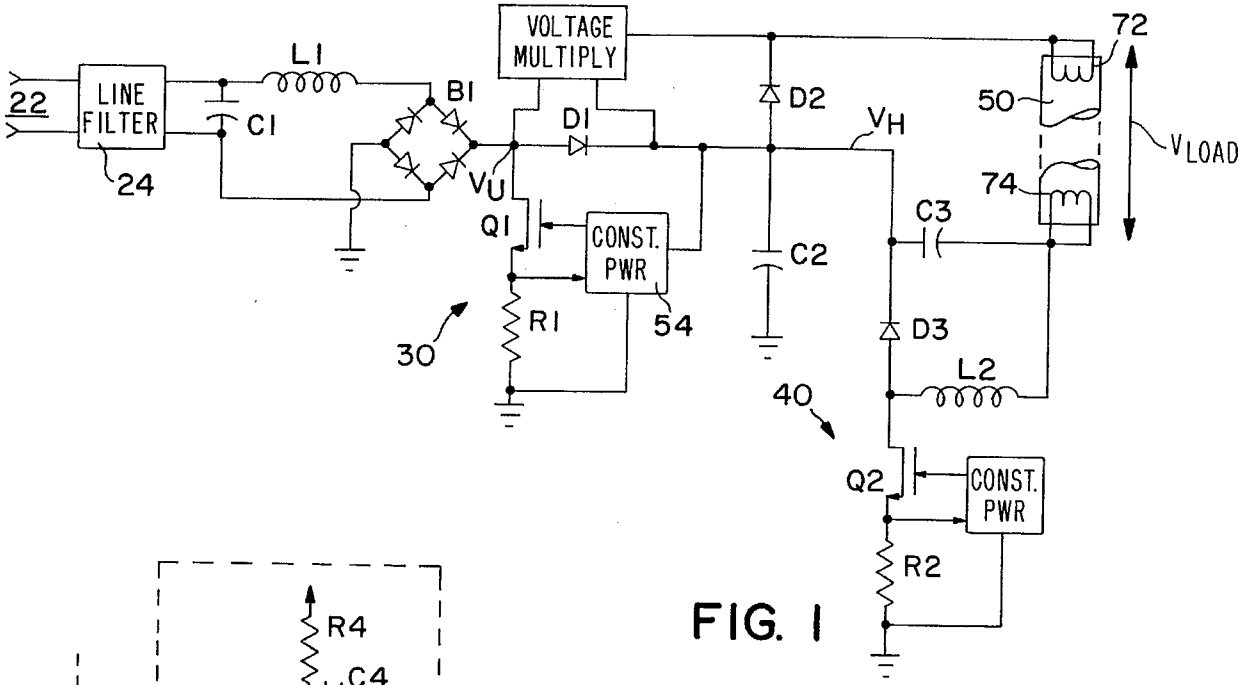
FIG. 1 is a schematic diagram illustrating a first embodiment of the invention.

Referring to the embodiment of the invention shown in FIG. 1, a bridge rectifier B1 is coupled to domestic mains 22 via a line filter 24, series inductor L1 and parallel capacitor C1, to provide an unregulated full wave rectified voltage $V_U$. A first constant power chopper regulator 30 produces a voltage $V_H$, and a second constant power regulator 40 applies the voltage across gas discharge tube 50, such as a fluorescent bulb or the like. The second power regulator 40, regulates the power level to a constant such that $V_{LOAD}$ across the tube 50 has a large DC component and a smaller AC component.

First constant power regulator or chopper 30 produces a square wave or pulse train output at about 30 KHz due to switching of MOSFET Q1 under control of a voltage controlled oscillator 54. There are a number of particular ways in which the constant power regulator can be embodied, one variation being shown in FIG. 2. The same reference numbers have been used in FIG. 2 and throughout the figures, to identify corresponding components. The pulse width and the frequency of switching of MOSFET Q1 are variable, such that the duty cycle of pulses is changed as a function of the current level, sensed by the voltage on resistor R1, in series with MOSFET Q1.

Figure 2:
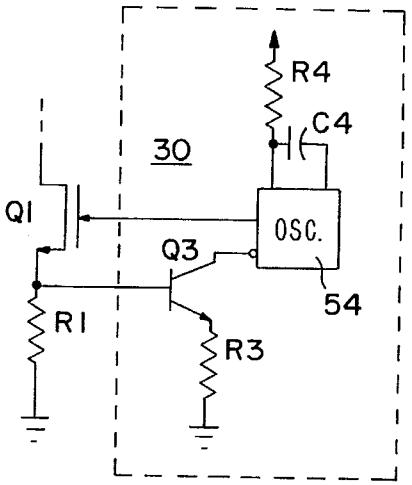
FIG. 2 is a schematic diagram showing an exemplary constant power regulator for inclusion in the embodiment according to FIG. 1.

As shown in FIG. 2, a voltage proportionate to current is produced across current sampling resistor R1 when MOSFET Q1 is conducting due to a high level on its gate from oscillator 54. The current-sense voltage across resistor R1 is applied to the base of switching transistor Q3. The emitter of transistor Q3 is coupled to ground through emitter resistor R3, and Q3 conducts and resets controlled oscillator 54 when the voltage on the base of switching transistor Q3 is sufficient to forward bias its base-emitter junction. Controlled oscillator 54 can comprise a feedback amplifier having a capacitor that is drained by transistor Q3, or a multivibrator that is reset by a low level at the collector of transistor Q1.

The voltage at the drain side of MOSFET Q1 is a square wave, having a DC component and an AC component. This voltage is coupled to charge filter capacitor C2 via diode D1, which prevents capacitor C2 from being drained through MOSFET Q1. The voltage $V_H$ across capacitor C2 is regulated to provide constant power rather than constant voltage, and varies, for example, between about 350 and 380 volts during startup, and between about 200 and 300 volts during normal operation of the lamp.

MOSFET Q1 works in a high efficiency switching mode. The current pulse width and period is controlled by the voltage on the sample resistor R1. A surge of current causes a corresponding surge in voltage on sample resistor R1, which turns MOSFET Q1 off. Under normal working conditions, the current pulse width is modulated in this way. After a fixed time delay, for example as determined by timing elements R4 and C4, MOSFET Q1 is turned back on. Shorter current pulses produce a higher switching frequency, and longer ones produce a lower switching frequency. The power applied to the load is kept constant by this combined pulse width and pulse frequency modulation method. Oscillator 54 preferably employs a CMOS integrated circuit, whereby the constant power circuits use only a small amount of energy. The circuit is also relatively simple and inexpensive.

Parallel capacitor C2 operates as a low pass filter to develop a DC component from the square wave at the source of MOSFET Q1. In addition, during starting when the resistance of load 50 is very high due to lack of ionization of the gas in the tube, capacitor C2 is charged and accumulates energy which is available to provide current to the filaments 72, 74 when the input side constant power regulator 30 works in its switching mode.

Figure 3:
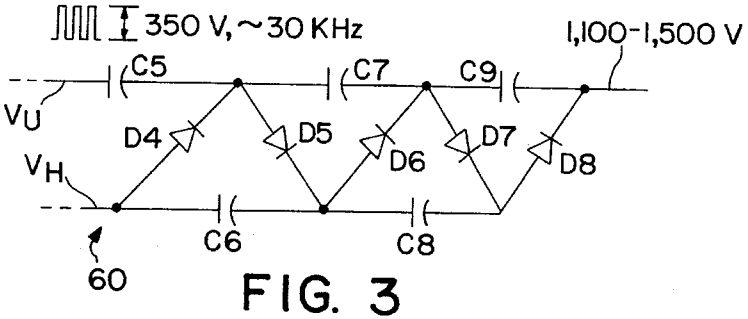
FIG. 3 is a schematic diagram showing an exemplary voltage multiplier according to the invention.

In the embodiment of FIG. 1, a voltage multiplier 60 is provided to provide an initial voltage boost across tube 50. As the resistance of tube 50 drops with ionization of the gas, the load on voltage multiplier 60 increases and current is supplied to tube 50 via diode D2. This saves the complicated design of a current source for supplying a large current during starting, and is self regulating in that voltage multiplier 60 can produce a high voltage only when the resistance of the load is high. FIG. 3 illustrates voltage multiplier 60.

Voltage multiplier 60 employs a number of series coupled capacitors C5–C9 and parallel forward biased diodes D4–D8 arranged in a ladder arrangement such that if the load is high in resistance, for example when first starting, upon switching of diodes D4–D8, capacitors C5–C9 are individually charged to the supply voltage. The voltage is added repetitively in this manner to provide at the output of multiplier 60 a multiple of the input voltage $V_H$. For example in the embodiment shown, from a square wave of about 350 to 380 volts peak, a high voltage of 1,100 to 1,500 can be provided to the tube positive filament 72. Diode D2 is reverse biased. The high voltage effects quick ionization of the gas in tube, causing the resistance between filaments 72, 74 to drop. Starting in this manner avoids the need to heat filaments 72, 74 resistively, which causes wear.

Capacitors C5–C9 preferably have a relatively small value, e.g., 100 picofarads. As the resistance of tube 50 drops, capacitors C5–C9 are discharged. Eventually, the voltage at the output of voltage multiplier 60 drops to less than $V_H$ and current is supplied through diode D2 to positive filament 72. In the operational mode after startup, current loading via voltage multiplier 60 is minimized (e.g., to about 1–5 mA) by the small value of the capacitors.

Figure 4:
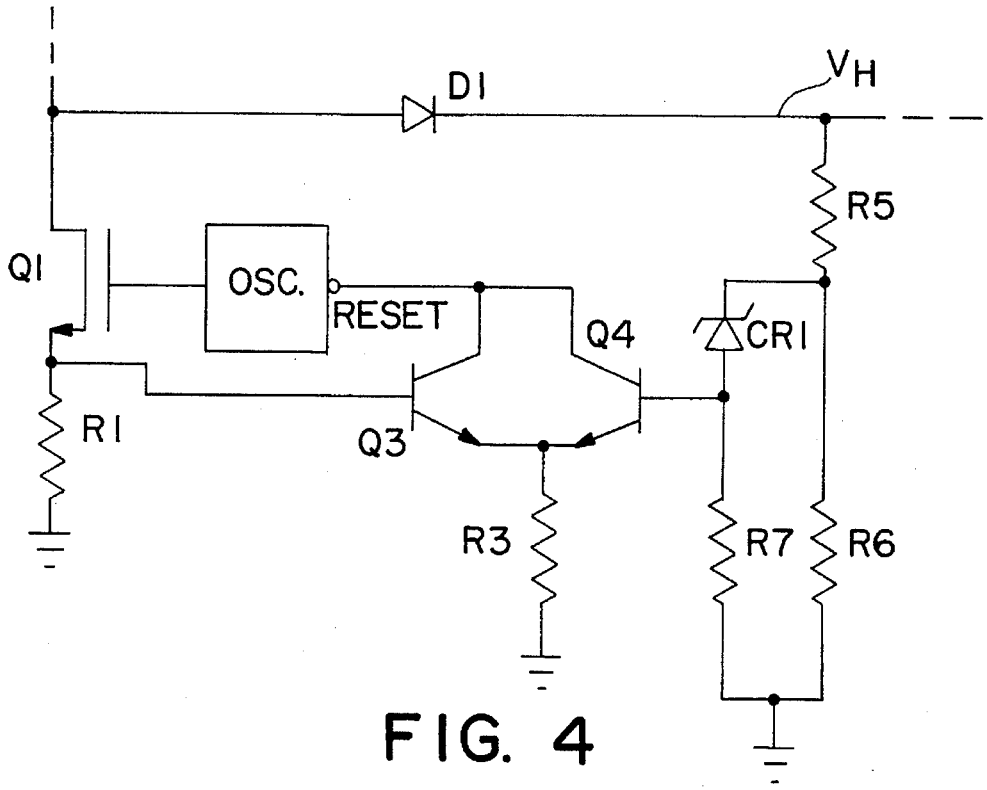
FIG. 4 is a schematic diagram showing an alternative input stage having a voltage limiting control for one or both of the constant power regulators.
Figure 5:
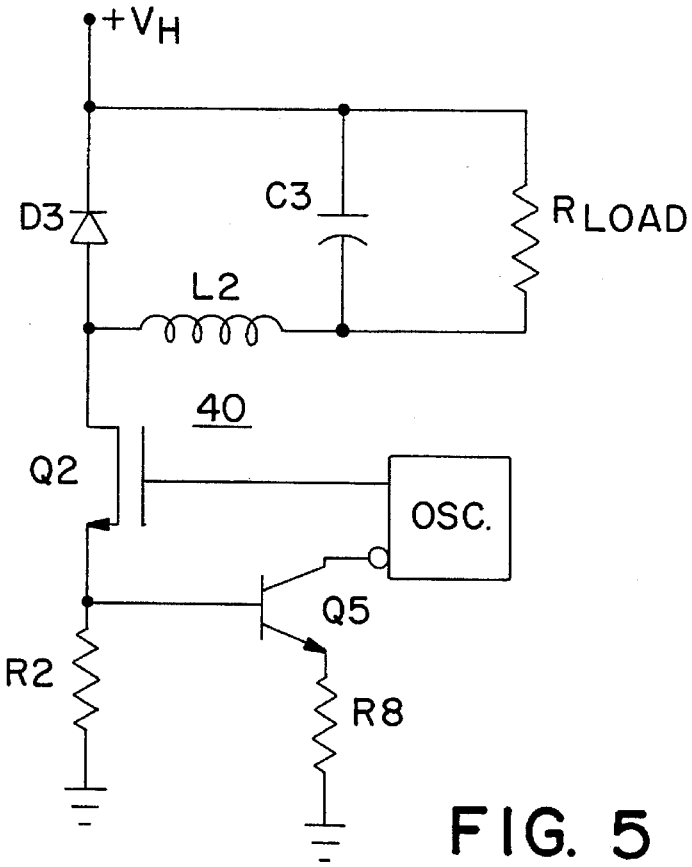
FIG. 5 is a partial schematic that is useful in explaining operation of the output side of the circuit.

A preferred input stage constant power regulator 30 is shown in FIG. 4, and a preferred output stage constant power regulator 40 is shown in FIG. 5. FIG. 4 includes current sense resistor R1, switching transistor Q3 and emitter resistor RR3, as in FIG. 1. In addition, this embodiment comprises a voltage limiting circuit including a voltage divider of resistors R5 and R6, coupled between $V_H$ and ground, a zener diode CR1 whose cathode is coupled to the R5/R6 voltage divider, and a switching transistor Q4 coupled in parallel with transistor Q3. If the voltage at $V_H$ increases to where the voltage at the junction or resistors R5 and R6 is greater than the breakdown voltage of zener CR1, then zener CR1 conducts through resistor R7, raising the voltage at the base of transistor Q4. When the voltage at the base of transistor Q4 is sufficient to cause transistor Q4 to conduct, oscillator 54 of regulator 30 is turned off, thereby setting voltage $V_H$ below a predetermined maximum.

In the output stage of FIG. 5, a corresponding constant power regulator 40 is coupled between the negative filament 74 of tube 50 and ground. As in the input stage, the constant power regulator 40 comprises a switching MOSFET Q2, a current sampling resistor R2 and a chopper oscillator 55 that is reset upon switching of transistor Q5 when the voltage on the base of transistor Q5 exceeds a level determined by emitter resistor R8.

FIG. 5 is useful to illustrate the application of current to load 50, a gas discharge tube or other load being represented by resistor $R_{LOAD}$ in the drawing. During starting, when voltage $V_H$ is present but the load resistance is quite high, turning on MOSFET Q2 substantially couples capacitor C3 and inductor L2 across voltage $V_H$. Capacitor C3 charges and a current is built up in inductor L2, in both cases storing energy. When MOSFET Q2 turns off, the back EMF of inductor L2 and the charge on capacitor C3 are applied to the positive filament 72 of tube 50. In this manner, power is applied to tube 50 both when MOSFET Q2 is on and when it is off.

Figure 6:
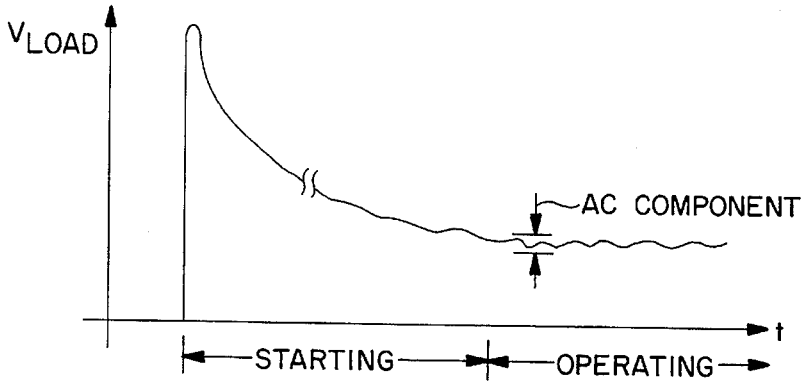
FIG. 6 is a plot of voltage over time, showing AC and DC components of the voltage applied to the load.

In steady state operation, the ballast operates in a larger DC/smaller AC mode, i.e., the voltage $V_{LOAD}$ across tube 50 has a DC component and an AC component. The ratio of DC to AC can be changed by adjusting the value of parallel capacitor C3. The starter preferably works at high speed to initiate conduction, by reaching a substantial DC voltage. As shown in FIG. 6, however, the voltage drops off to the larger DC/smaller AC working mode wherein the AC component is about ten percent of the level of the DC component. The voltage $V_{LOAD}$ applied upon starting and in the steady state is shown in FIG. 6.

Figure 7:
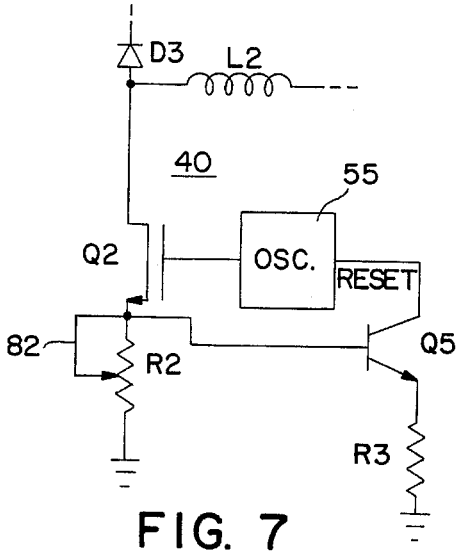
FIG. 7 is a schematic diagram showing an alternative embodiment including a manually operable dimmer control.

According to an inventive aspect, the constant power regulator according to the invention can be used as a means to control the output in a dimming control arrangement. FIG. 7 shows use of a manual adjustment potentiometer 82 to control the current level in chopper MOSFET Q2 at which oscillator 55 is turned off, in particular by adjusting the value of current sensing resistor R2. The same sort of arrangement is also possible with respect to the input stage as shown in FIG. 4, for example using a potentiometer (not shown) to alter the voltage division between resistors R5 and R6. Other forms of dimming control are also possible, including automatic rather than manual dimming control, for example using optical sensing means (not shown) to feed back a signal representing light level for controlling the chopper current level or otherwise to adjust the operation of the oscillator. A thermal sensing means (not shown) is also possible, for reducing the output level as the bulb warms up over a period of time.

Whereas the voltage applied to the load is a larger DC/smaller AC signal of about 90% direct current and 10% alternating current, the positively-charged gas ions remain more mobile than in a full DC type ballast, thereby minimizing problems with electrophoresis.

A conventional warm-start ballast uses four to six watts of power to operate its controls, out of 68 to 70 watts of total power dissipation. Instant start ballast arrangements having a starter for heating the filaments use less power in steady state operation, e.g., 62 to 64 watts in a comparable arrangement. However, heating the filaments tends to shorten the life of the bulbs. The invention uses about 65 watts to start. This power is dissipated by electrically ionizing the gas rather than by heating the filaments, and no active switching elements are needed. In steady state operation, the bulbs can be operated at about 60 watts total power dissipation, and with substantially reduced emission of electromagnetic interference. In practice, the invention begins steady state operation at a slightly higher wattage, and reduces its power output as the ballast and the bulb heat up. The reduced power results from the faster switching of the current sensing transistors Q2 and Q3 over time, due to the negative temperature coefficient of transistors as switching means.

Figure 8:
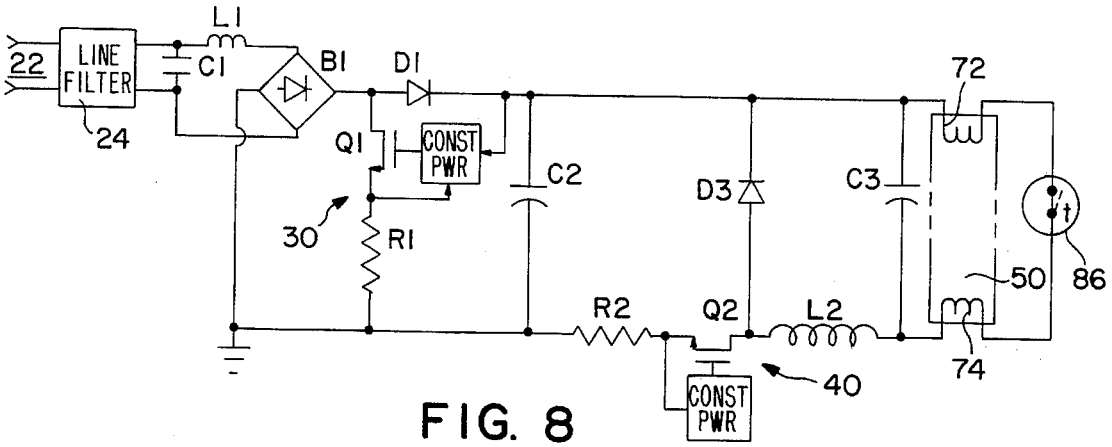
FIG. 8 is a schematic diagram showing an alternative embodiment using a filament-warming starter.

The invention is also applicable to a ballast having a conventional starter for resistively heating the filaments, for example a bimetallic switch 86 as shown in FIG. 8. This embodiment is substantially the same as the embodiment of FIG. 1 and also operates in a larger DC/smaller AC mode. Instead of a voltage multiplier for the starting means, this embodiment uses bimetallic starter switch 86, coupled to short the two filaments 72, 74 across the power supply, in series with inductor L2 and having a current limited by second constant power regulator 40. After a short time sufficient to ionize the gas by heating filaments 72, 74, starter switch 86 opens and the device functions as described above.

Accordingly, the invention provides a ballast power supply circuit for operating a load 50. A rectifier B1 is coupleable to an AC power source 22 for providing an unregulated DC signal $V_U$. A constant power regulator 30, 40 is coupled to the unregulated DC signal $V_U$ and has a control input Q3, Q5, the constant power regulator including an oscillator 54, 55 and switching means Q1, Q2 coupled to the oscillator 54, 55, the switching means being coupled to the unregulated DC signal $V_U$ and the oscillator 54, 55 operating the switching means Q1, Q2 at a variable frequency and a variable pulse width responsive to the control input, producing a regulated output $V_H$. A capacitor C2, C3 and an inductor L2 are coupled to the switching means Q1 via a blocking diode D1, D3, for storing and discharging power to the load 50 during alternate cycles of the switching means Q1, Q2. Preferably, on constant power regulator 30 is used to provide a supply voltage $V_H$ and a second constant power regulator 40 applies the supply voltage to the load. The second constant power regulator 40 is coupled to the capacitor and inductor network, and has a second control input, the second constant power regulator including an oscillator 55 and switching means Q2 coupled to the oscillator 55, the switching means Q2 being coupled in series with the load 50 for controlling an operational power level and the oscillator 55 operating the switching means at a variable frequency and a variable pulse width responsive to the control input.

The regulated output $V_H$ is coupled to a first terminal 72 of the load 50 via a forward biased diode D1, D2 and to a second terminal 74 of the load 50 via a series capacitor C3 of the capacitor and inductor network, an inductor L2 of the capacitor and inductor network being coupled between the second terminal 74 of the load 50 and the second constant power regulator 40.

In a preferred arrangement a starting circuit 60 is coupled to the chopped signal that develops the regulated output $V_H$, and has a plurality of serially coupled forward-biased diodes D4–D8 and a plurality of capacitors C5–C9 coupled between anodes and cathodes of adjacent ones of the diodes, for multiplying a voltage of the regulated output $V_H$, the starting circuit 60 providing a relatively higher startup voltage to a first terminal 72 of the load 50, and being loaded such that the startup voltage drops off with decreasing resistance of the load.

The regulated output is coupled to a parallel capacitor C2 for maintaining a DC component of the voltage of the regulated output, the regulated output being coupled to a first terminal 72 of the load, the capacitor and inductor network include a capacitor C3 in parallel with the load 50, which forms a resistance $R_{LOAD}$ and an inductor L2 in series with the load, the second constant power regulator 40 being coupled in series with the inductor L2. A diode D3 having an anode coupled to the inductor L2 and a cathode coupled to the first terminal 72 of the load, discharges stored energy from the capacitor C3 and inductor L2 to the load 50, when the switching means Q2 of the second constant power regulator 40 turns off, and the inductor L2 and capacitor C3 accumulate energy when the switching means Q2 conducts to apply power to the load.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A ballast power supply circuit for operating a load, comprising:

a rectifier coupleable to an AC power source for providing an unregulated DC signal;

a first constant power regulator and a filter coupled to the unregulated DC signal, the first constant power regulator including an oscillator having a control input and switching means coupled to the oscillator, the switching means being coupled to the unregulated DC signal and the oscillator operating the switching means at a variable frequency and a variable pulse width responsive to the control input, the variable frequency being defined by a variable on time and a fixed off time, the control input being coupled to a current sensing resistor such that an increase in current through the current sensing resistor produces a corresponding increase in voltage at the control input for resetting the oscillator at a predetermined current, the oscillator remaining reset for the duration of the fixed off time, the switching means with variable frequency and variable pulse width thereby delivering constant power to the load, the first constant power regulator producing a regulated output and being operable to provide a larger DC/smaller AC voltage applied to the load, having a DC component and an AC component, whereby electrophoresis effects are minimized; and, a capacitor and an inductor coupled to the switching means via a blocking diode, for storing and discharging power to the load during alternate cycles of the switching means.

2. A ballast power supply circuit for operating a load comprising:

a rectifier coupleable to an AC power source for providing an unregulated DC signal;

a first constant power regulator coupled to the unregulated DC signal and having a control input, the first constant power regulator including an oscillator and switching means coupled to the oscillator, the switching means being coupled to the unregulated DC signal and the oscillator operating the switching means at a variable frequency and a variable pulse width responsive to the control input, the first constant power regulator producing a regulated output;

a second constant power regulator coupled to the capacitor and inductor network, and having a second control input, the second constant power regulator including a second oscillator and second switching means coupled to the second oscillator, the second switching means being coupled in series with the load for controlling an operational power level and the second oscillator operating the second switching means at a variable frequency and a variable pulse width responsive to the second control input; and a capacitor and an inductor coupled to the second switching means via a blocking diode, for storing and discharging power to the load during alternate cycles of the switching means.

3. The ballast power supply circuit of claim 2, wherein the second control input is coupled to at least one of a current sensing resistor and a manually adjustable dimming control.

4. The ballast power supply circuit of claim 2, wherein the regulated output is coupled to a first terminal of the load via a forward biased diode and to a second terminal of the load via said capacitor of the capacitor and inductor network, said inductor of the capacitor and inductor network being coupled between the second terminal of the load and the second constant power regulator.

5. The ballast power supply circuit of claim 4, further comprising a starting circuit coupled to the regulated output, comprising a plurality of serially coupled forward-biased diodes and a plurality of capacitors coupled between anodes and cathodes of adjacent ones of the diodes, for multiplying a voltage of the regulated output, the starting circuit providing a relatively higher startup voltage to the first terminal of the load, and being loaded such that the startup voltage drops off with decreasing resistance of the load.

6. The ballast power supply circuit of claim 4, wherein the regulated output is coupled to a parallel capacitor for maintaining a DC component of the voltage of the regulated output, the regulated output being coupled to the first terminal of the load, the capacitor and inductor network comprising the capacitor, in parallel with the load, and a resistor in series with the load, the second constant power regulator being coupled in series with the inductor, and further comprising a diode having an anode coupled to the inductor and a cathode coupled to the first terminal of the load.

7. The ballast power supply circuit of claim 6, further comprising a starter switching device in parallel with the load, the starter switching device being operable to resistively heat electrodes coupled to the terminals of the load and to open upon reaching predetermined temperature.

8. A ballast power supply circuit for operating a load, comprising:

a rectifier coupleable to an AC power source for providing an unregulated DC signal;

a first constant power regulator coupled to the unregulated DC signal and having a first control input, the first constant power regulator including an oscillator and switching means coupled to the oscillator, the switching means being coupled to the unregulated DC signal and the oscillator operating the switching means at a variable frequency and a variable pulse width responsive to the first control input;

a capacitor and inductor network coupled to the switching means via a blocking diode, the capacitor and inductor network storing and discharging power to the load during alternate cycles of the switching means, respectively;

a second constant power regulator coupled to the capacitor and inductor network, and having a second control input, the second constant power regulator including a second oscillator and second switching means coupled to the second oscillator, the second switching means being coupled in series with the load for controlling an operational power level and the second oscillator operating the second switching means at a variable frequency and a variable pulse width responsive to the second control input.

9. A ballast power supply circuit for operating a gas discharge load, comprising:

a rectifier coupleable to an AC power source for providing an unregulated DC signal;

a first regulator coupled to the unregulated DC signal and having a control input, the first regulator including an oscillator and switching means coupled to the oscillator, the switching means being coupled to the unregulated DC signal and providing a pulse train output;

a second constant power regulator coupled to a capacitor and inductor network, and having a second control input, the second constant power regulator including a second oscillator and second switching means coupled to the second oscillator, the second switching means being coupled in series with the load for controlling an operational power level and the second oscillator operating the second switching means at a variable frequency and a variable pulse width responsive to the second control input;

a capacitor coupled to the pulse train output for developing a continuous voltage having a DC component, the capacitor being coupled to a first terminal of the load via a coupling diode; and, a starting circuit comprising a plurality of serially coupled forward-biased diodes and a plurality of capacitors coupled between anodes and cathodes of adjacent ones of the forward-biased diodes, for multiplying a voltage across the load, the starting circuit providing a relatively higher startup voltage which is coupled to the first terminal of the load via the coupling diode, and being loaded such that the startup voltage drops off with decreasing resistance of the load.

10. The ballast power supply circuit of claim 9, wherein the second control input is coupled to at least one of a current sensing resistor and a manually adjustable dimming control.

11. The ballast power supply circuit of claim 9, wherein the regulated output is coupled to the first terminal of the load via a forward biased diode and to a second terminal of the load via a series capacitor of the capacitor and inductor network, an inductor of the capacitor and inductor network being coupled between the second terminal of the load and the second constant power regulator.

* * * * *